US010934913B2

(12) United States Patent
Sakuma

(10) Patent No.: US 10,934,913 B2
(45) Date of Patent: Mar. 2, 2021

(54) CATALYTIC DEVICE AND EXHAUST GAS PURIFICATION SYSTEM

(71) Applicant: TOYOTA JIDOSHA KABUSHIKI KAISHA, Toyota (JP)

(72) Inventor: Tetsuya Sakuma, Gotemba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/668,352

(22) Filed: Oct. 30, 2019

(65) Prior Publication Data

US 2020/0141296 A1 May 7, 2020

(30) Foreign Application Priority Data

Nov. 6, 2018 (JP) ..... JP2018-208969

(51) Int. Cl.
*F01N 3/20* (2006.01)

(52) U.S. Cl.
CPC ..... *F01N 3/202* (2013.01)

(58) Field of Classification Search
None
See application file for complete search history.

(56) References Cited

U.S. PATENT DOCUMENTS 5,940,022 A 8/1999 Takatsu
2016/0363022 A1* 12/2016 Hoki ..... F01N 3/035

FOREIGN PATENT DOCUMENTS

DE 19538799 A1 4/1997
EP 0872911 A2 * 10/1998 ..... H05B 6/108
JP 04353208 A * 12/1992 ..... F01N 3/202
JP H05-222924 A 8/1993
JP H10-288027 A 10/1998

OTHER PUBLICATIONS

Fukuda et al. JP04-353208A-translated document (Year: 1992).*

* cited by examiner

*Primary Examiner* — Jelitza M Perez
(74) *Attorney, Agent, or Firm* — Oliff PLC

(57) ABSTRACT

The disclosure aims to attain further early activation of a catalytic substance in a catalytic device arranged in an exhaust passage of an internal combustion engine. A catalytic substance and a microwave absorber are included in a catalytic layer of the catalytic device which is irradiated with a microwave in the exhaust passage. Then, in the catalytic layer, the catalytic substance is carried or supported by the microwave absorber without through other substances.

4 Claims, 5 Drawing Sheets

CATALYTIC DEVICE AND EXHAUST GAS PURIFICATION SYSTEM

CROSS REFERENCE TO THE RELATED APPLICATION

This application claims the benefit of Japanese Patent Application No. 2018-208969, filed on Nov. 6, 2018, which is hereby incorporated by reference herein in its entirety.

BACKGROUND

Technical Field

The present disclosure relates to a catalytic device arranged in an exhaust passage of an internal combustion engine, and to an exhaust gas purification system for an internal combustion engine.

Description of the Related Art

In patent literature 1, there is disclosed a technique for a catalytic converter having a catalyst of a small capacity and another catalyst of a large capacity arranged at the downstream side of the small capacity catalyst. With the technique described in this patent literature 1, the small capacity catalyst is formed by coating a catalytic coating material containing a catalytic substance made of noble metal and a microwave absorber on a substrate made of ceramics. Then, a microwave is irradiated to the small capacity catalyst by means of a microwave oscillator arranged in a catalytic converter.

CITATION LIST

Patent Document

Patent Literature 1: Japanese patent application laid-open publication No. H05-222924

SUMMARY

There has been known a catalytic device having a catalytic layer formed of a catalytic coating material which includes a catalytic substance and a microwave absorber configured to absorb a microwave thereby to generate heat, as mentioned above. When the microwave is irradiated to the catalytic device that is configured to include the microwave absorber, the microwave absorber absorbs the microwave thereby to generate heat. With this, a rise in temperature of the catalytic layer is promoted, thus making it possible to attain early activation of the catalytic substance included in the catalytic layer. Then, in an exhaust gas purification system for an internal combustion engine, exhaust emission can be improved by activating the catalytic substance in the catalytic device arranged in an exhaust passage at an early stage.

However, in a conventional catalytic device, there is generally included a carrier substance for carrying or supporting a catalytic substance, in addition to the catalytic substance and a microwave absorber. This is because, with the catalytic substance carried or supported by the carrier substance, the catalytic substance is held in the catalytic device in a state where it is diffused in the catalytic layer. Then, with such a configuration, the size of grains of the carrier substance is very large in comparison with that of grains of the catalytic substance. For that reason, when the microwave absorber generates heat by irradiation of a microwave, the heat generated in the microwave absorber will first conduct to the carrier substance, and after that, will further conduct to the catalytic substance through the carrier substance. When such a heat conduction path from the microwave absorber to the catalytic substance in the catalytic layer is taken into consideration, there is room to attain further early activation of the catalytic substance in the catalytic device.

The present disclosure has been made in view of the above-mentioned circumstances, and has for its object to attain further early activation of a catalytic substance in a catalytic device arranged in an exhaust passage of an internal combustion engine.

A catalytic device according to a first aspect of the present disclosure may be arranged in an exhaust passage of an internal combustion engine, and be irradiated with a microwave in the exhaust passage, wherein the catalytic device may have a catalytic layer configured to include a catalytic substance and a microwave absorber to generate heat by absorbing the microwave, and in the catalytic layer, the catalytic substance may be supported by the microwave absorber without through other substances.

The catalytic device according to the present disclosure may be arranged in the exhaust passage of the internal combustion engine as an exhaust gas purification apparatus. Hie catalytic device may have the catalytic layer. The catalytic layer may be configured to include the catalytic substance and the microwave absorber. The catalytic substance may be a noble metal. In the catalytic device arranged in the exhaust passage of the internal combustion engine, when the catalytic substance included in the catalytic layer is activated, an exhaust gas is purified by the catalytic substance. The microwave absorber is a substance that has a microwave absorption performance higher than that of the catalytic substance included in the catalytic layer. The microwave is irradiated to the catalytic device arranged in the exhaust passage of the internal combustion engine. Hie microwave absorber has a property of generating heat by absorbing the microwave irradiated to the catalytic device.

In addition, in the present disclosure, in the catalytic layer, the catalytic substance may be carried or supported by the microwave absorber without through other substances. That is, in the catalytic layer, the catalytic substance may be directly carried or supported by the microwave absorber. In other words, the microwave absorber also may have a function as a carrier substance.

In cases where the catalytic device arranged in the exhaust passage has such a configuration as described above, when the microwave is irradiated to the catalytic device so that the microwave absorber included in the catalytic layer generates heat, the heat generated in the microwave absorber will directly conduct to the catalytic substance. In that case, a rise in the temperature of the catalytic substance will be promoted more, as compared with the case where the heat generated in the microwave absorber conducts to the catalytic substance through other carrier substances. Accordingly, according to the present disclosure, in the catalytic device arranged in the exhaust passage of the internal combustion engine, it is possible to attain further early activation of the catalytic substance.

Here, the specific surface area of grains of the microwave absorber included in the catalytic layer of the catalytic device according to the present disclosure may be equal to or more than 40 $m^2/g$. Here, in a catalytic layer of a conventional catalytic device, the specific surface area of grains of zirconia (CZ), which is a kind of a carrier substance used in order to support a catalytic substance, is generally about 40 $m^2/g$. Accordingly, when the specific surface area of grains of the microwave absorber is equal to or more than 40 $m^2/g$, it becomes possible to directly support the catalytic substance by the microwave absorber.

An exhaust gas purification system for an internal combustion engine according to a second aspect of the present disclosure may comprise: a catalytic device according to the first aspect of the disclosure arranged in an exhaust passage of the internal combustion engine; and an irradiation device configured to irradiate a microwave to the catalytic device in the exhaust passage.

According to such an exhaust gas purification system, further early activation of a catalytic substance in the catalytic device can be attained by irradiating a microwave to the catalytic device from the irradiation device.

According to the present disclosure, it is possible to attain further early activation of a catalytic substance in a catalytic device arranged in an exhaust passage of an internal combustion engine.

DESCRIPTION OF THE EMBODIMENTS

Hereinafter, specific embodiments of the present disclosure will be described based on the attached drawings. However, the dimensions, materials, shapes, relative arrangements and so on of component parts described in the embodiments are not intended to limit the technical scope of the present disclosure to these alone in particular as long as there are no specific statements.

(Schematic Construction of Exhaust System)

Figure 1:
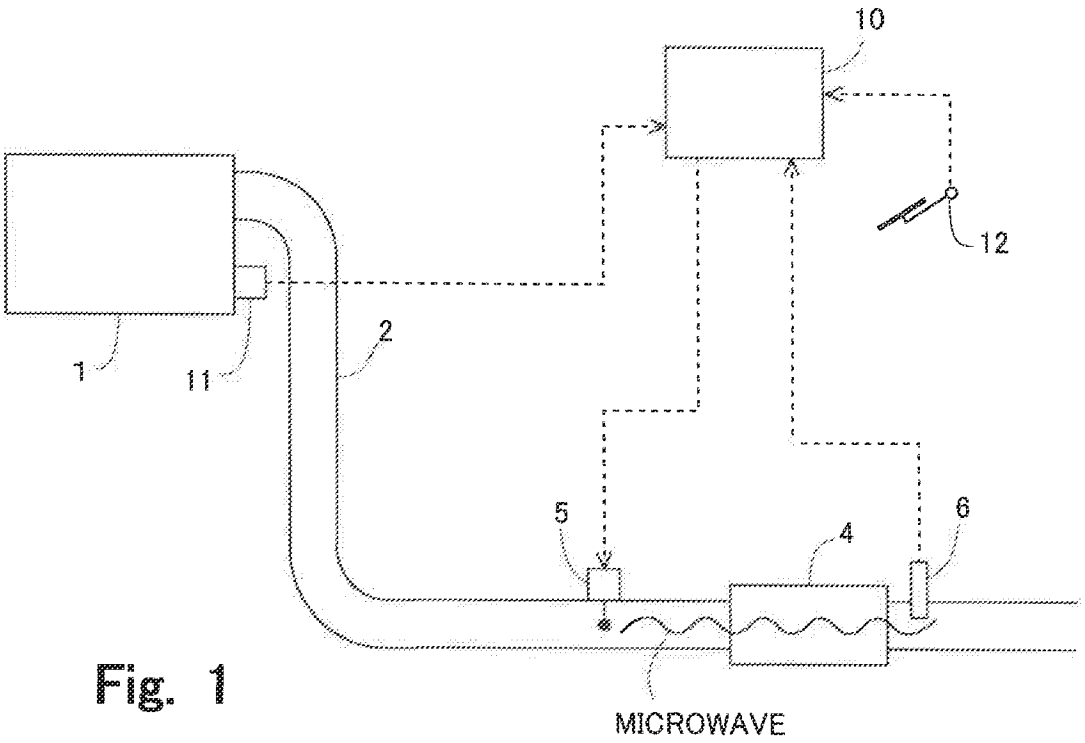
FIG. 1 is a view illustrating the schematic construction of an exhaust system of an internal combustion engine according to an embodiment of the present disclosure.

FIG. 1 is a view illustrating the schematic construction of an exhaust system of an internal combustion engine according to an embodiment. The internal combustion engine denoted by 1 is a gasoline engine for driving a vehicle. An exhaust passage 2 is connected to the internal combustion engine 1. A catalytic device 4 is arranged in the exhaust passage 2. This catalytic device 4 is a three-way catalyst for purifying or removing HC (hydrocarbon), CO (carbon monoxide), and NOx (nitrogen oxides) in the exhaust gas. Here, note that the configuration of the catalytic device 4 will be described later. In addition, a temperature sensor 6 is arranged in the exhaust passage 2 at the downstream side of the catalytic device 4. The temperature sensor 6 is to detect the temperature of exhaust gas flowing out of the catalytic device 4.

In addition, an irradiation device 5 is arranged in the exhaust passage 2 at the upstream side of the catalytic device 4. The irradiation device 5 is to irradiate a microwave to the catalytic device 4. The irradiation device 5 is provided with a microwave oscillator and a microwave radiator. As the microwave oscillator, there can be used a semiconductor oscillator, for example. Then, the irradiation device 5 irradiates the microwave generated by the microwave oscillator to the catalytic device 4 from the microwave radiator. Here, note that, in this embodiment, the catalytic device 4 corresponds to a "catalytic device" according to the present disclosure, and the irradiation device 5 corresponds to an "irradiation device" according to the present disclosure. However, the "catalytic device" according to the present disclosure is not limited to a three-way catalyst, but may be a simple oxidation catalyst, etc.

Moreover, an electronic control unit (ECU) 10 is provided in combination with the internal combustion engine 1. Various devices such as a throttle valve arranged in an intake passage of the internal combustion engine 1, fuel injection valves of the internal combustion engine 1, etc., are electrically connected to the ECU 10. Thus, these devices are controlled by the ECU 10.

Also, the temperature sensor 6 is electrically connected to the ECU 10. Further, a crank position sensor 11 and an accelerator opening sensor 12 are electrically connected to the ECU 10. Then, detected values of the individual sensors are inputted to the ECU 10. The ECU 10 estimates the temperature of the catalytic device 4 based on the detected value of the temperature sensor 6. In addition, the ECU 10 derives an engine rotational speed of the internal combustion engine 1 based on the detected value of the crank position sensor 11. Also, the ECU 10 derives an engine load of the internal combustion engine 1 based on the detected value of the accelerator opening sensor 12.

Moreover, the irradiation device 5 is electrically connected to the ECU 10. The ECU 10 carries out microwave irradiation processing by controlling the irradiation device 5. The microwave irradiation processing is to irradiate a microwave of a predetermined frequency to the catalytic device 4. The microwave irradiation processing is carried out in cases where there is a request for raising the temperature of the catalytic device 4, for example, such as when the internal combustion engine 1 is cold started. In this case, the predetermined frequency in the microwave irradiation processing is decided based on experiments, etc., as a frequency suitable for raising the temperature of the catalytic device 4.

(Catalytic Device)

Figure 2:
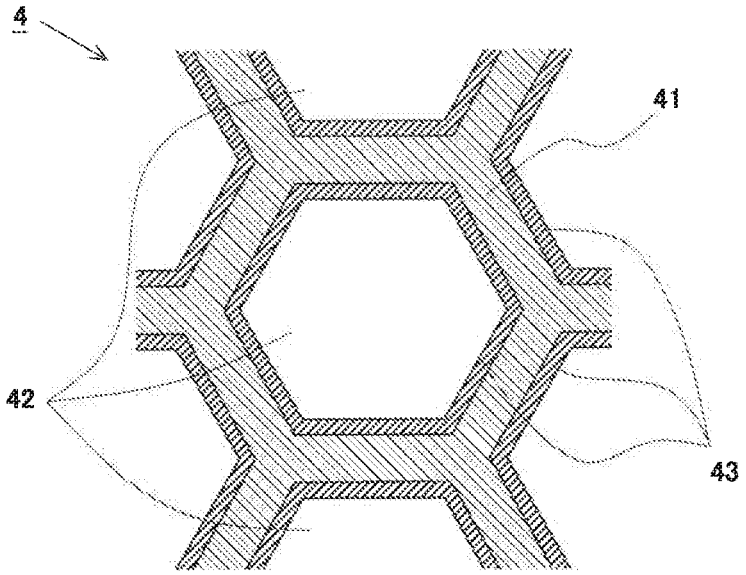
FIG. 2 is a view enlarging a part of a cross section of a catalytic device in a direction perpendicular to the direction of flow of exhaust gas.
Figure 3:
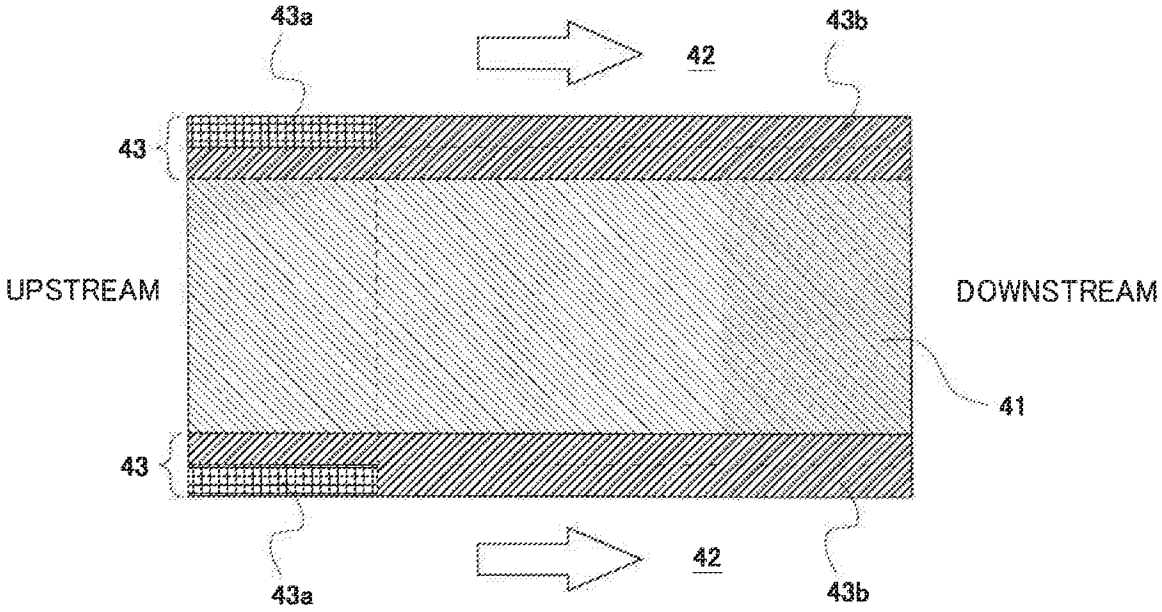
FIG. 3 is a view enlarging a part of a cross section of the catalytic device in a direction along the direct ion of flow of exhaust gas.
Figure 4:
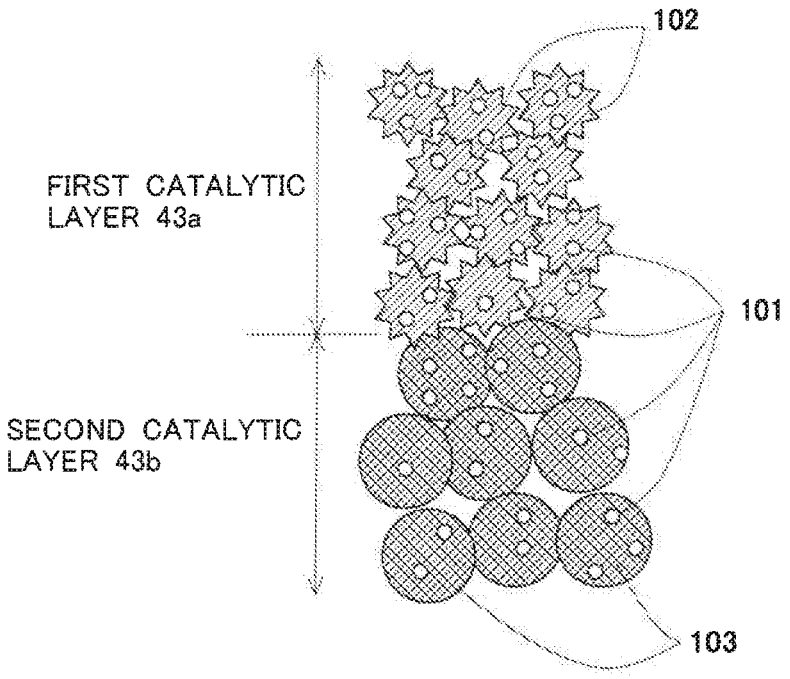
FIG. 4 is a conceptual view for explaining the configuration of a catalytic layer in the catalytic device according to the embodiment.

Here, the schematic configuration of the catalytic device 4 according to this embodiment will be explained based on FIG. 2 through FIG. 4. FIG. 2 is a view enlarging a part of a cross section of the catalytic device 4 in a direction perpendicular to the direction of flow of exhaust gas. FIG. 3 is a view enlarging a part of a cross section of the catalytic device 4 in a direction along the direction of flow of exhaust gas. FIG. 4 is a conceptual view for explaining the configuration of a catalytic layer in the catalytic device 4.

The catalytic device 4 is a three-way catalyst of wall-flow type having a plurality of cells 42 extending in the direction of flow of exhaust gas. In the catalytic device 4, each cell 42 is divided by a partition wall 41. As illustrated in FIG. 2, in the catalytic de/ice 4, a catalytic layer 43 is formed by a coating material containing a plurality of kinds of catalytic materials composed of noble metals on the partition wall 41 in a substrate (i.e., on the wall surface of each cell 42). Here, Pd (palladium) and Rh (rhodium) can be exemplified as the catalytic materials. Then, in the catalytic device 4, HC, CO and NOx in the exhaust gas are removed (oxidized or reduced) by the individual catalytic materials included in the catalytic layer 43.

Further, a microwave absorber in addition to the catalytic materials is included in the catalytic layer 43. The microwave absorber is a substance that is higher in microwave absorption performance than each of the catalytic materials included in the catalytic layer 43. In addition, the microwave absorber has a property of generating heat by absorbing the microwave of the predetermined frequency irradiated from the irradiation device 5 to the catalytic device 4.

However, in the catalyst layer 43 of the catalytic device 4, the microwave absorber is not distributed uniformly, but is distributed over only apart of the catalyst layer 43. Specifically, the catalytic layer 43 of the catalytic device 4 has a first catalytic layer 43*a* and a second catalytic layer 43*b*, as illustrated in FIG. 3. FIG. 3 illustrates the distribution of the first catalytic layer 43*a* and the second catalytic layer 43*b* in the catalytic layer 43 formed on the partition wall 41 of the catalytic device 4. Here, note that in FIG. 3, white arrows (defined by outlines) indicate the direction of flow of exhaust gas flowing in the cells 42.

As mentioned above, in the catalytic device 4, the catalytic layer 43 is formed on the partition wall 41 which divides the cells 42 extending along the flow of the exhaust gas. Then, as illustrated in FIG. 3, in the catalytic layer 43, the first catalytic layer 43*a* is formed in an upstream portion thereof which is located at the upstream side along the flow of the exhaust gas, and in an exhaust gas contacting portion which is located in a place directly exposed to the exhaust gas flowing in the cells 42 (i.e., a portion of the catalytic layer 43 which is in non-contact with the partition wall 41 in cases where the catalytic layer 43 is divided into two in a direction perpendicular to the partition wall 41). In addition, the second catalytic layer 43*b* is formed in that portion of the catalytic layer 43 which is other than the portion in which the first catalytic layer 43*a* is formed. In other words, in the catalytic layer 43, the second catalytic layer 43*b* is formed in an exhaust gas non-contacting portion which is located in a place not directly exposed to the exhaust gas flowing in the cells 42 in the upstream side portion in which the first catalytic layer 43*a* is formed (i.e., that portion of the catalytic layer 43 which is in contact with the partition wall 41 in cases where the catalytic layer 43 is divided into two in the direction perpendicular to the partition wall 41), and in a downstream side portion located at the downstream side of that portion in which the first catalytic layer 43*a* is formed, along the flow of the exhaust gas.

Then, in the catalytic layer 43, the microwave absorber is included only in the first catalytic layer 43*a*. That is, the microwave absorber is not included in the second catalytic layer 43*b*. Here, the substance structures of the first catalytic layer 43*a* and the second catalytic layer 43*b* will be explained based on FIG. 4.

As mentioned above, the microwave absorber denoted by 102, in addition to a catalytic substance denoted by 101, is included in the first catalytic layer 43*a*. Then, in this first catalytic layer 43*a*, the catalytic substance 101 is carried or supported by the microwave absorber 102 without through other substances. In other words, in the first catalytic layer 43*a*, the catalytic substance 101 is directly carried by the microwave absorber 102.

On the other hand, a carrier substance 103, which is another substance for carrying or supporting the catalytic substance 101, is included in the second catalytic layer 43*b* in which the microwave absorber 102 is not included. Then, in the second catalytic layer 43*b*, the catalytic substance 101 is carried or supported by the carrier substance 103. Here, as the carrier substance 103, there can be mentioned, by way of example, zirconia (CZ) or alumina ($Al_2O_3$). This carrier substance 103 hardly absorbs microwave, and hence does not function as the microwave absorber.

The specific surface area of grains of the carrier substance 103 is equal to or more than 40 $m^2/g$. Thus, with the catalytic substance 101 carried by the carrier substance 103, the catalytic substance 101 can be held in a state of being diffused in the second catalytic layer 43*b*. Further, in this embodiment, the specific surface area of grains of not only the carrier substance 103 but also the microwave absorber 102 included in the first catalytic layer 43*a* is equal to or more than 40 $m^2/g$. As a result of this, the catalytic substance 101 can be carried directly by the microwave absorber 102, and the catalytic substance 101 can be held in a state of being diffused in the first catalytic layer 43*a*.

(Advantageous Effects of the Configuration of this Embodiment)

Figure 5:
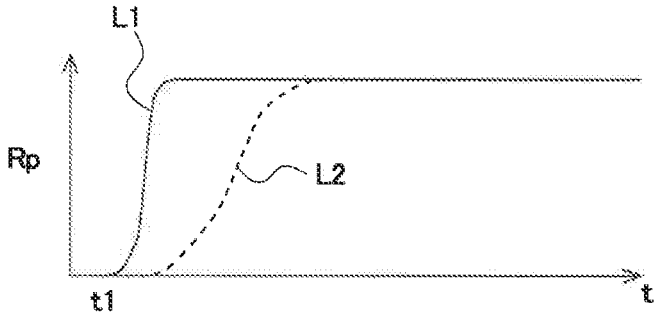
FIG. 5 is a time chart illustrating the change over time of an HC purification (oxidation) ratio Rp in the catalytic device at the time when a microwave is irradiated to the catalytic device from an irradiation device at cold start of the internal combustion engine.

Next, advantageous effects of the configuration of the catalytic device according to this embodiment will be explained based on FIG. 5. FIG. 5 is a time chart illustrating the change over time of an HC purification (oxidation) ratio Rp in the catalytic device 4 at the time when a microwave is irradiated to the catalytic device 4 from the irradiation device 5 at cold start of the internal combustion engine 1. In FIG. 5, a solid line L1 represents the change over time of the HC oxidation ratio Rp in the catalytic device 4 according to this embodiment, and a broken line L2 represents the change over time of the HC oxidation ratio Rp in a catalytic device according to a comparative example. Here, note that in FIG. 5, the axis of abscissa represents time t. Then, in FIG. 5, at time t1, the internal combustion engine 1 is started, and the irradiation of a microwave from the irradiation device 5 to the catalytic device 4 is also started.

Figure 6:
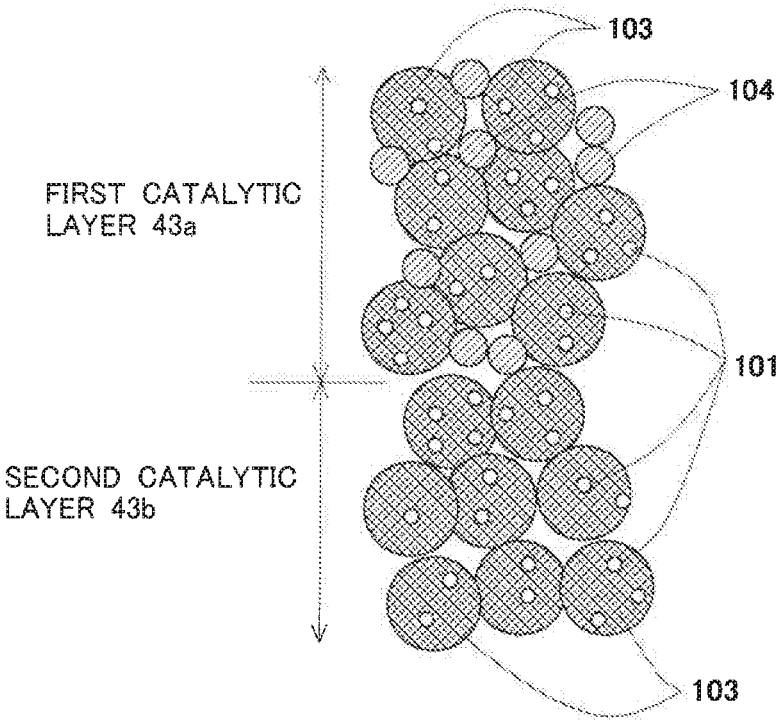
FIG. 6 is a conceptual view for explaining the configuration of a catalytic layer in a catalytic device according to a comparative example.

Here, there will be explained, based on FIG. 6, the substance structure of the catalytic layer in the catalytic device according to the comparative example in which the change over time of the HC oxidation ratio Rp is illustrated by the broken line L2 in FIG. 5. FIG. 6 is a conceptual view for explaining the structure of the catalytic layer in the catalytic device according to the comparative example. Here, the catalytic layer in the catalytic device according to the comparative example has a first catalytic layer and a second catalytic layer, similar to the catalytic device 4 according to this embodiment. In other words, in the catalytic layer in the catalytic device according to the comparative example, too, the first catalytic layer and the second catalytic layer are distributed at locations as illustrated in FIG. 3, respectively. However, in the catalytic device according to the comparative example, the substance structure of the first catalytic layer is different from that of the first catalytic layer 43*a* in the catalytic device 4 according to this embodiment.

Specifically, as illustrated in FIG. 6, the first catalytic layer in the catalytic device according to the comparative example includes a microwave absorber 104 and a carrier substance 103 in addition to a catalytic substance 101. The carrier substance 103 here is the same as the carrier substance 103 included in the second catalytic layer 43*b* in the catalytic device 4 according to this embodiment. On the other hard, the microwave absorber 104 is different from the microwave absorber 102 included in the first catalytic layer 43*a* in the catalytic device 4 according to this embodiment.

Then, in the first catalytic layer in the catalytic device according to the comparative example, the catalytic substance 101 is carried or supported by the carrier substance 103. In other words, the catalytic substance 101 is not directly supported by the microwave absorber 104. This is because the specific surface area of grains of the microwave absorber 104 is very small in comparison with the specific surface area of grains of the carrier substance 103, and it is difficult for the microwave absorber 104 to support the catalytic substance 101.

Here, note that the substance structure of the second catalytic layer in the catalytic device according to the comparative example is the same as that of the second catalytic layer 43*b* in the catalytic device 4 according to this embodiment. In other words, the microwave absorber 104 is not included in the second catalytic layer in the catalytic device according to the comparative example, and the catalytic substance 101 is supported by the carrier substance 103 in the second catalytic layer.

In the catalytic device according to the comparative example as constructed above, in cases where the microwave absorber 104 included in the first catalytic layer generates heat by the irradiation of a microwave to the catalytic device, the heat generated in the microwave absorber 104 first conducts to the carrier substance 103. Then, the heat will conduct to the catalytic substance 101 through the carrier substance 103. In other words, the heat generated in the microwave absorber 104 does not easily conduct directly to the catalytic substance 101.

In contrast to this, in the catalytic device 4 according to this embodiment, the catalytic substance 101 is directly carried or supported by the microwave absorber 102 in the first catalytic layer 43*a*, as mentioned above. In other words, in the first catalytic layer 43*a* in the catalytic device 4 according to this embodiment, the specific surface area of grains of the microwave absorber 102 is equivalent to the specific surface area of a substance such as zirconia (CZ) or the like, which can be the carrier substance 103, and hence, the microwave absorber 102 also has a function as a carrier substance.

Then, in cases where the catalytic substance 101 is directly carried or supported by the microwave absorber 102 in this manner, when a microwave is irradiated to the catalytic device 4 so that the microwave absorber 102 generates heat, the heat generated in the microwave absorber 102 in the first catalytic layer 43*a* will directly conduct to the catalytic substance 101 without through other substances. For that reason, in the first catalytic layer 43*a* of the catalytic device 4 according to this embodiment, a rise in the temperature of the catalytic substance 101 will be promoted more, as compared with the case where the heat generated in the microwave absorber 104 conducts to the catalytic substance 101 through other substances (carrier substance 103), as in the catalytic device according to the comparative example. In other words, with the configuration according to this embodiment, the temperature of the catalytic substance 101 rises more quickly in comparison with the configuration according to the comparative example. Accordingly, further early activation of the catalytic substance 101 can be attained.

As described above, according to the configuration of this embodiment, in the first catalytic layer 43*a*, the catalytic substance 101 can be activated at an earlier stage, in comparison with the configuration according to the comparative example. Accordingly, as illustrated in FIG. 5, when the internal combustion engine 1 is started and the irradiation of a microwave from the irradiation device 5 to the catalytic device 4 is also started at time t1, the HC oxidation ratio (L1) in the catalytic device 4 according to this embodiment will rise more quickly than the HC oxidation ratio (L2) in the catalytic device according to the comparative example. Here, note that this is a tendency resulting from the early activation of the catalytic substance 101, and hence, a CO removal (oxidation) ratio and an NOx removal (reduction) ratio in addition to the HC oxidation ratio exhibit the same tendency. Thus, according to the configuration of this embodiment, the exhaust emission of the internal combustion engine 1 can be improved by attaining further early activation of the catalytic substance 101.

(Modifications)

Here, note that in this embodiment, a carrier substance in addition to the microwave absorber 102 may be included in the first catalytic layer 43. In this case, the catalytic substance 101 will be supported by both of the microwave absorber 102 and the other carrier substance. However, in such a case, in the catalytic substance 101 directly supported by the microwave absorber 102, the heat generated in the microwave absorber 102 conducts directly to the catalytic substance 101. Accordingly, it is possible to attain further early activation of the catalytic substance 101.

In addition, although in the above-mentioned embodiment, reference has been made to the case where the catalytic layer 43 is composed of the first catalytic layer 43*a* and the second catalytic layer 43*b*, the configuration of the catalytic layer 43 is not limited to this. For example, there can also be adopted, a configuration in which the microwave absorber 102 is uniformly distributed ever the entire catalytic layer 43. Moreover, for example, there can also be adopted a configuration in which the second catalytic layer 43*b* in the above-mentioned embodiment is further divided into two catalytic layers in which the inclusion ratios of individual catalytic substances included therein are mutually different from each other.

What is claimed is:

1. A catalytic device which is arranged in an exhaust passage of an internal combustion engine and which is irradiated with a microwave in the exhaust passage, the catalytic device having a catalytic layer configured to include a catalytic substance and a microwave absorber to generate heat by absorbing the microwave, wherein a first catalytic layer and a second catalytic layer are formed in the catalytic layer, wherein, in the first catalytic layer, the catalytic substance is supported by the microwave absorber without through other substances, and a carrier substance other than the microwave absorber is not included, and in the second catalytic layer, the catalytic substance is supported by the carrier substance.

2. The catalytic device as set forth in claim 1, wherein the specific surface area of grains of the microwave absorber is equal to or more than 40 $m^2/g$.

3. An exhaust gas purification system for an internal combustion engine comprising:

a catalytic device, as set forth in claim 1, arranged in an exhaust passage of the internal combustion engine; and a microwave radiator arranged in the exhaust passage, wherein the microwave radiator irradiates a microwave to the catalytic device.

4. An exhaust gas purification system for an internal combustion engine comprising:

a catalytic device, as set forth in claim 2, arranged in an exhaust passage of the internal combustion engine; and a microwave radiator arranged in the exhaust passage, wherein the microwave radiator irradiates a microwave to the catalytic device.

* * * * *